United States Patent [19]

Baldwin et al.

[11] 4,038,131

[45] July 26, 1977

[54] SHORT CYCLE PRESSED FIBERBOARD MANUFACTURING PROCESS

[75] Inventors: Stanley H. Baldwin, Oakville; Arnold E. Willoughby, Mississauga, both of Canada

[73] Assignee: Abitibi Paper Company Ltd., Canada

[21] Appl. No.: 620,182

[22] Filed: Oct. 6, 1975

[51] Int. Cl.[2] ..... D21J 1/04

[52] U.S. Cl. ..... 162/103; 162/164 R; 162/225

[58] Field of Search ..... 162/225, 103, 123, 125, 162/129, 164, 267, 164 R; 428/219

[56] References Cited

U.S. PATENT DOCUMENTS

| | | | |
|---|---|---|---|
| 1,663,505 | 3/1928 | Mason | 162/225 X |
| 1,862,688 | 6/1932 | Loetscher | 162/225 |
| 1,900,698 | 3/1933 | Ellis | 162/225 X |
| 2,046,750 | 7/1936 | Mason et al. | 162/225 X |
| 3,223,579 | 12/1965 | Dorland et al. | 162/123 |
| 3,367,828 | 2/1968 | Carter et al. | 162/225 |

*Primary Examiner*—S. Leon Bashore

*Assistant Examiner*—Richard V. Fisher

*Attorney, Agent, or Firm*—Stevens, Davis, Miller & Mosher

[57] ABSTRACT

Pressed fiberboard is produced in an S-1-S type process at much shorter than normal (prior art) press cycles. The process includes the use of fiber furnish having preselected shrinkage characteristics. This furnish is wet formed into a mat either with or without a paper overlay, which overlay may be decorated or undecorated, depending on the desired end use and pressed wet as in the S-1-S process, using control means, such as stop bars in the hot press, to limit the final separation distance between the hot plates in each press opening to provide full caliper reduced density board. By using a fiber furnish having selected shrinkage characteristics it has been found that the pressed board can be safely removed from the press in a semi-cured, moist condition, at unusually short press cycles. The use of said fiber furnish also permits the use of higher than normal (prior art) press temperatures without incurring discloration of the paper overlays. The board is then baked and humidified to complete the curing process.

36 Claims, 2 Drawing Figures

SHORT CYCLE PRESSED FIBERBOARD MANUFACTURING PROCESS

This invention relates generally to improvements in processes for manufacturing pressed fiberboard panelling, and has particular advantages in connection with, but is not limited to, the manufacture of reduced density pressed fiberboard h ving decorative surfaces thereon for interior use.

In manufacturing processes generally the principal objective is to produce the best possible product for the end use intended, at the lowest possible manufacturing cost. The invention set forth herein assists in accomplishing this ultimate goal with pressed fiberboard to a much greater degree than heretofore possible with existing commercial processes.

The length of the press cycle used, i.e. the time taken in the hot press for the crucial act of consolidating and converting the raw fiber into a pressed fiberboard, is the basic determining factor in production rate and hence process cost and profitability. Other important process cost factors include the amount and types of chemical additives required, furnish weight per unit surface area (i.e. basis weight) of product, and amount of post hot press or secondary finishing needed.

Important physical criteria for customer acceptability in the case of interior pressed fiberboard panelling include attractiveness, which involves a consideration of surface texture and colour design, and ease of handling and workability during installation. Product attractiveness requires a process capable of producing pressed fiberboard having a high level of embossing capability and wide range of colour control, while ease of handling and workability is best accomplished by producing board at reduced densities which provides lighter weight panels having easier and better nailability. The latter eliminates puckering of board surface around nail heads and collapse of the slim, decorative pressed fiberboard nails during hammering with attendant safety hazards to the applicator.

The ability to maintain full caliper (thickness) is also very important for both adequate development of embossing depth (and hence product attractiveness) and also improvement of stiffness of the wall panel. However, in normal high density pressed fiberboard processes, greater thickness requires greater furnish weight and longer press cycles, both of which result in increased costs. Thus, providing the product thickness really desired is normally costly and often considered unfeasible.

Pressed fiberboard building panelling is normally made by one of the following three basic processes:

(1) wet S-1-S (Smooth-One-Side), (2) wet S-2-S (Smooth-Two-Sides), or (3) dry (S-1-S or S-2-S).

Figure 1:
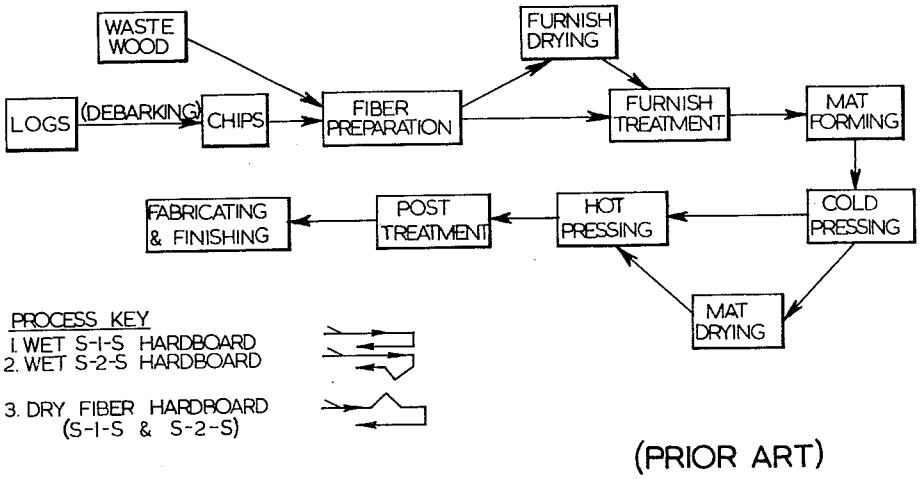
(PRIOR ART) FIG. 1
FIG. 1 shows very briefly the main steps in each of the three basic pressed fiberboard processes. The accompanying "Process Key" shows the schematic flow for each of the processes.

With reference to FIG. 1, the wet S-1-S (Smooth-One-Side) type pressed fiberboard process includes the following steps: wood chipping (where necessary); fiber preparation (usually steam cooking and mechanical refining); washing and chemically treating the furnish (including the addition of binding resins, sizes, and pH adjusting chemicals); forming the wet mat by drainage of an aqueous suspension; partially dewatering the mat by cold pressing; hot pressing the cold pressed wet mat on a wire backing screen (against a patterned top caul plate where surface embossing is desired); post baking and re-humidifying the hot pressed board in ovens and humidifying chambers; and fabricating and finishing the surface as desired Wet process S-2-S (Smooth-Two-Sides) follows the same initial procedures as S-1-S up to the cold pressed wet mat stage but then the mat goes into hot air dryers where the moisture content is reduced to a low value (e.g. less than 1%). The dried mat is then hot pressed at a high temperature typically 235°–260° C. (approximately 450°–500° F.) and a high pressure, typically 500–1000 p.s.i., using a short press cycle, without a backing screen. It then follows the same process flow as the S-1-S type process for post-treatment, fabrication and finishing.

Dry pressed fiberboard (either S-1-S or S-2-S) follows the same general process sequence as wet process S-1-S except that the fiber furnish is dried after preparation from the wood chips and before chemical addition and mat formation. Fiber handling and mat forming techniques, of course, differ from wet process methods since the fiber is handled in air and not in water.

Each of the above noted processes has particular advantages and disadvantages. The wet S-1-S process affords good natural fiber-to-fiber interfelting and bonding with minimum added binder required, provides a moist surface of high plasticity which gives the desired embossing sensitivity, and allows the additional use of in-process overlays (as taught in U.S. Pat. Nos. 2,918,398; 3,223,579; 3,576,711) to provide smooth, sealed, out-of-press decorative or paintable surfaces at normal press temperatures e.g. 175°–200° C. (approximately 350°–390° F.). However, the press cycles required are relatively long (e.g. 8–12 minutes for nominal ¼ inch panelling) and the required times are very sensitive to caliper increases. The standard way of reducing press cycle time is to raise the press temperature. However, in-press surfaces are then subject to discolouration from the prolonged contact with the hotter platens. Thus, there is a practical upper limit on the degree of reduction of press cycle time permitted by merely increasing press temperatures. Also the density of the wet S-1-S product is high (e.g. the specific gravity is about 0.9 to 1.0).

The wet S-2-S process and the fully dry processes allow shorter hot press cycles since almost all of the moisture is removed prior to hot pressing and because higher press temperatures can then also be used. However, they do not afford the aforementioned surface quality or overlay advantages of the wet S-1-S process, thus requiring more costly post-press finishing procedures. Again, in-press surfaces are subject to discolouration resulting from dry contact with the press platens at the elevated press temperatures commonly used. Densities are again generally high where short press cycles are achieved. In addition, the dry process does not provide the natural wet felting bond of the wet S-1-S and wet S-2-S processes and hence the dry process requires more costly binder addition for property development. Also the handling of dry fiber suspensions in air, particularly hot air, is generally a dusty and hazardous operation from the potential explosion and fire hazard point of view.

The principal object of this invention is to provide an improved process for making pressed fiberboard, which process combines the advantages of the three existing major conventional processes described above, while at the same time substantially reducing their major shortcomings.

A major object of the present invention is to provide an improved pressed fiberboard manufacturing process which enables much shorter than normal (prior art) hot press cycle times to be used thus resulting in greater productivity and lower production costs.

A further object of the present invention is to provide an improved, wet-process pressed fiberboard manufacturing process providing good natural fiber bonding and hence providing good substrate quality with minimum binder addition while providing for the use of the economically crucial short press cycles.

A further object is to provide a process of making pressed fiberboard having a highly embossed, sealed, decorative overlay surface out-of-press, requiring minimal surface finishing.

A futher object is to provide a pressed fiberboard making process which allows the use of more efficient increased hot press temperatures with resulting short pressing cycles without, at the same time, incurring surface discolouration problems.

A futher object is to provide for the economical manufacture of reduced density pressed fiberboard at full thickness or caliper, with attendant furnish cost savings and improved product appearance and workability.

In general, the process of the present invention involves the use of a fiber furnish having preselected "shrinkability" characteristics. This furnish is wet formed into a mat either with or without a paper overlay, which overlay may be decorated or undecorated, depending on the desired end use, and pressed wet as in the S-1-S process, using control means, such as stop bars, in the hot press to limit the final separation distance between the hot plates in each press opening, thereby to provide full caliper, reduced density board. The invention involves the discovery that the use of fiber furnish of selected shrinkage characteristics in a hot press having control means therein as described above allows the pressed board to be safely removed from the press in a semi-cured, moist condition, at unusually short press cycles. The invention also allows the use of higher than normal (prior art) press platen temperatures without incurring discolouration, which discolouration is particularly offensive when decorative overlay surfaces are being provided on the board.

After the pressing operation the semi-cured pressed board is then transported in a manner, such as in the horizontal position, which will avoid distortion damage, through baking and humidifying chambers where the curing process is completed. The result is the production of a reduced density pressed fiberboard panelling of excellent and wide ranging decorative appeal and superior thickness and working properties at production rates at least twice that achieved with existing conventional wet S-1-S processes.

As briefly described above, the use of a pre-selected fiber furnish with predetermined shrinkability characteristics is the key requirement for the short cycle process of the present invention. At the termination of the very short hot pressing times realized in accordance with the inventive process, the board still contains a substantial amount of moisture and is only semi-cured and structurally quite weak. Steam is still being created inside the board and if the hot press were opened at this stage of a normal (prior art) pressed fiberboard hot press cycle the board would immediately delaminate or "blow". However, the use of a fiber furnish with appropriate "shrinkability" characteristics, coupled with press stops of appropriate thickness allows the semi-cured mat to gradually shrink in thickness sufficiently to reduce the pressure between itself and the control or stop-restrained hot pressure platen, thus allowing gradual dissipation of the internal steam pressure and preventing sudden delamination of the pressed board after the short press cycle. Controlled and predetermined shrinkage then continues as the board cure is completed in subsequent oven heat treatment to the final desired caliper and density. Early shrinkage of the mat, as described above, during the press cycle also prevents local overheating of the board surface due to prolonged pressurized contact with the hot press plate surface and thus allows the combined use of higher than normal press temperatures with decorative overlay surfaces, without undesirable discolouration consequences. The use of a thermosetting resin in the furnish chosen to assist in developing early in-press bonding is also helpful in many cases in providing adequate out-of-press strength to the semi-cured moist board.

Since the shrinkability characteristics of the fiber furnish are of primary importance in the process of the invention, it is necessary to determine and define the pertinent shrinkability characteristics in question for any given fiber furnish. Thus, the term "Shrinkability Value" has been adopted to define said shrinkability characteristics and the following "Shrinkability Value" test procedure has been developed and can be used as a fiber qualification test for the process of the present invention. The method also determines the "Drainage Time" of the fiber, — a well known and accepted measure of the rate at which a wet mat can be formed on a screen from an aqueous dispersion of the fiber in question.

Shrinkability Value Test Method

Weigh out 10.6 grams (oven dry basis) of the moist fiber furnish to be evaluated and disperse this in water at 80° Fahrenheit (27° C.) in a Williams Drainage Tester apparatus according to TAPPI Standard Method T1002 sm-60. Dewater as directed and record the Drainage Time in seconds. Then remove the resulting wet formed pad (three inches in diameter) from the apparatus and carefully cold press it on a 16-mesh wire screen (to allow escape of expressed water) between smooth metal caul plates to a pressure of 100 pounds per square inch. A small (e.g. 6 inch 6 inch) laboratory press is best suited for this step. Hold the pad at pressure for 30 seconds or until no more liquid water is being expelled. Release the pressure, remove from the wire screen and after one minute measure the thickness of the cold pressed pad in mils (1 mil = 0.001 inch = 25.4 microns) using a caliper gauge as specified for insulation board (Ref. ASTM C209-72, Section VI) i.e. having broad (1-inch diameter), flat contact feet to avoid penetration of the soft fiber pad surface by the caliper jaws and weighted with a ten ounce weight to provide consistent intimate contact of the contact feet to the fiber pad surface. Dry the cold pressed pad completely in a forced air drying oven at 200 degrees Fahrenheit (93° C.). Measure the dried mat thickness in mils. Calculate the Shrinkability Value as follows:

$$\text{Shrinkability Value} = \text{Dried Mat Thickness (mils)} -$$

-continued

| | | Cold Pressed Mat Thickness (mils). |
|---|---|---|
| Example: | | |
| 1. Cold pressed mat thickness | = | 418 mils |
| Dried mat thickness | = | 445 mils |
| Shrinkability Value | = 445 − 418 | = +27 mils |
| 2. Cold pressed mat thickness | = | 410 mils |
| dried mat thickness | = | 398 mils |
| Shrinkability Value | = 398 − 410 | = −12 mils |

It has been discovered that fiber furnishes with a Shrinkability Value of under about +80 mils work best in this process. Fibers above +80 mils and up to +100 mils are generally operable but may require somewhat longer press cycles and/or more resin addition, thus diminishing the desired economic advantage. Fibers between +100 mils and +120 mils produce results which could be said to be just within the range of operability. However, the advantages over the prior art are substantially diminished and operation within this range is not generally recommended. Above about +120 mils, shrinkability characteristics are so weak as to militate against the results desired from this novel process. Fibers with Values below zero, i.e. negative Values, are acceptable regarding their shrinkage but slow drainage may become a problem in this range. The fiber must be free-draining for board manufacture, i.e. drainage must be such that the wet mat can be successfully formed on commercial equipment at the desired basis weights and the required production speeds.

The Shrinkability Value can readily be converted to metric system units. Using the conversion 1 mil equals 25.4 microns the following Shrinkability Values in microns are obtained:

Shrinkability Value of +120 mils = approximately +3000 microns.
Shrinkability Value of +100 mils = approximately +2500 microns
Shrinkability Value of +80 mils = approximately +2000 microns.

While it is recognized that the "Shrinkability Value" test method usually involves "springback" measurement rather than shrinkage per se — nevertheless it is preferred to use the term "Shrinkability Value" which represents the "reduction of springback". In the actual boardmaking process according to the invention it is the eventual shrinkage of the mat during hot pressing that is the critical determining factor in the length of the press cycle and even though the "Shrinkability Value" test method pad actually expands on oven drying, it is the degree of this expansion which measures the "shrinkability" characteristic of the fiber for the process of the invention.

In accordance with a typical procedure according to the method a wood chip mixture is cooked with steam under pressure and mechanically refined using techniques and equipment generally common to the hardboard manufacturing art but with conditions chosen to provide fibers having the "shrinkability" characteristics as outlined above. Chip steaming is carried out either batch style or continuously in separate vessels or "digesters" under saturated steam pressures in the range of 30 to 160 p.s.i.g. for times of 1 to 7 minutes, depending on the wood species, wood physical state and defibration conditions to be used. Defibration of the steamed chips is then accomplished in conventional double or single rotating disc mechanical refiners fitted with metal plates having matching patterns of teeth, bars or the like. Fiber "shrinkability" can be dependent to varying degrees on several factors related to the wood, such as species, bark content, age and condition of the raw wood supply, but the most important factor for the present process has been found to involve the manner in which the defibration of the wood is accomplished. Defibration carried out at temperatures below the lignin softening range (i.e. temperatures corresponding to approximately 30–50 p.s.i.g. steam pressure) usually produces fibers with the desired fibrillation and open surface to enhance natural fiber-to-fiber bonding on drying of the reduced density mat and accompanying positive shrinkage of the interfelted fibrous network. Defibration at temperatures above the lignin softening range, as in the case of high temperature pressurized refining, usually softens the natural lignin binder in the chips to the point where the fibers are separated easily without surface fibrillation and also allows the softened lignin to coat and seal the individual fibers. Such unfibrillated, sealed fibers form wet mats with good drainage properties due to the hydrophobicity of the fibers but on drying at reduced densities the resulting pressed mats do not produce good natural fiber-to-fiber bonding and contraction of the fibrous wet. At the same time the present invention is not to be bound by any particular theory concerning the refining technique. Those skilled in the art, and having knowledge of the shrinkability characteristics required for the successful operation of the invention and the test for determining the "Shrinkability Value" as outlined above coupled with the other teachings contained herein, will be readily enabled to put the invention into practice.

The in-process shrinkage of the formed mat is also affected by other process factors besides the fiber shrinkability, such as the amount of resin addition, press temperature and severity of post press oven treatment, but the shrinkability characteristic of the fiber furnish used is the key and governing factor in the present short cycle process. Manipulation of resin amounts and pressing cycles can be employed to compensate for some degree of fiber shrinkability variation, but the basic fiber furnish must exhibit the requisite range of shrinkability as outlined above to allow realization of the full potential of the present process.

The refined fibers, which are dispersed in an aqueous slurry (typically about 3% consistency) are then preferably treated with a suitable thermosetting resin such as a water soluble phenolic resin e.g. an acid-precipitable alkaline phenol formaldehyde resin of the advanced Redfern type as is commonly used in pressed fiberboard manufacture. In certain instances, very little or even no resin may be required, as when the fibers are of such character as to produce good natural fiber-to-fiber bonds and when longer press cycles with lower out-of-press board moisture contents are used. In other cases where the natural fiber-to-fiber bonding is of below average strength and where high out-of-press moisture contents are involved, up to about 3% resin may be required. However, under average conditions the preferred range of resin content is from about ½% to about 2% with the optimum resin content being from about 1% to about 1½%. Small amounts of other additives, as is common in the manufacture of pressed fiberboard, may be added, such as alum, typically in the amount of 1%, to cause precipitation and fixing of the binder and a sizing agent. The latter typically comprises a paraffin wax emulsion which is usually added in the amount of about ½%. All resin and other additive amounts are in terms of solids on total board solids by weight. The usual final pH of the fiber-chemical mix is around 4.0–4.5.

Those skilled in the art will realize that other thermosetting resins besides the phenolics may be used such as melamines, polyesters, certain acrylics, resorcinols, some polyurethanes and urea formaldehydes as long as they are capable of providing the required out-of-press board strengths at the relatively high out-of-press moisture contents (preferably 15 to 30% but in some cases as high as 40% on dry weight basis) which are typical in the practice of the present invention.

The resulting fiber furnish slurry is then formed into a conventional wet process fiberboard lap on a suitable forming machine e.g. a flat Fourdrinier or a cylinder machine, and is then dewatered by suction boxes and cold pressing to a consistency generally in the order of 30% (i.e. 70% moisture content). The basis weight per unit area is selected in accordance with the desired final caliper and density.

Where desired, a suitable overlay paper is then applied to the upper surface of the mat. The overlay paper is decorated with a selected woodgrain or other pattern in the case of interior decorative pressed fiberboards while in the case of non-decorated panels, plain paper is used. The paper overlay is typically of a newsprint type and carries on its underside, i.e. the side which contacts the upper surface of the wet mat, a suitable bonding agent such as a freshly applied mixture comprising raw linseed oil catalyzed with 5% by weight boron trifluoride ($BF_3$). The use of the oil and $BF_3$ bonding agent is more fully described in U.S. Pat. No. 3,301,744 (Hossain). This bonding agent is typically applied in the amount of $3\frac{1}{2}$ lb/thousand sq. feet of paper.

The endless mat (still at the same consistency as before) with or without a paper overlay, is then cut into suitable lengths, usually about 16 ft., placed on carrying screens, and then conveyed into the hot press in the manner well known in the art.

The hot press is of conventional design and may include a textured top caul plate having a desired pattern thereon to provide an embossed pattern on the panel; alternatively the top caul plate can be smooth to provide a smooth panel surface. The press includes stop bars at the longitudinal edges of the press plates which may be slotted to assist expressed water to drain away. The stop bars are dimensioned to perform several important functions. Firstly, they limit the degree of closing of the press platens, thus preventing the mat from being compressed beyond the point necessary to provide the desired caliper and the desired density in the final board product. A further very important function of the stops in the present invention is that they prevent the press platens from moving towards one another as the mat shrinks and decreases in thickness during the short press cycle, such shrinking of the mat being made possible, as explained previously, by virtue of the use of fiber of controlled or preselected shrinkage characteristics. The shrinkage of the mat during pressing reduces the time that the top surface or paper overlay of the board being formed remains in intimate pressurized contact with the hot platen thus reducing the possibility of discolouration and at the same time allowing for the use of higher than normal (prior art) pressing temperatures. The shrinkage of the mat also relieves the pressure between the mat and the top press platen and thus allows for the gradual dissipation of the steam pressures being generated inside the board during the pressing cycle and prevents sudden delamination of the board upon removal of same from the press after a short press cycle. As a result of these principal factors, the overall press cycle time can be reduced to the order of one-third or less of the press cycle time required in the production of pressed fiberboards of comparable thicknesses, in accordance with conventional prior art processes, thus resulting in substantial savings in production costs. In order to provide the above, the stop bars are dimensioned to take advantage of the "shrinkability" characteristics of the fiber. The stop bar thickness cannot ordinarily be related to the pre-pressed mat thickness since there are many variables affecting such thickness, but can be related approximately to the thickness of the final board after oven baking and humidification. In general, it can be said that the stop bars must be at least slightly thicker than the thickness of the final board product. Stop bars having a thickness very approximately 20% greater than the final board thickness will, in general, yield good results. However, this figure is not to be taken as a limitation on the invention but only as a guide to those in the art.

The press temperatures used in the process can vary considerably. Temperatures from about 190° to about 245° C (approximately 370° to 470° F) may be used when decorative overlays are being applied, while in the case of plain (no overlay) boards or non-decorative overlays somewhat higher temperatures are used i.e. from about 190° to about 260° C (approximately 370° to 500° F). The preferred temperature range in the cases of both decorative and non-decorative overlays is from about 205° to 235° C (approximately 400° to 450° F).

Non-decorative overlays or no overlay permit the use of higher press temperatures due to the fact that a small amount of discolouration is not detrimental to the product as it is either ultimately coated with a suitable pigmented finish coat which effectively covers up any discoloured portions or it is used in applications where the discolouration is acceptable. However, the decorative overlays must not be discoloured by the press and hence somewhat lower press temperatures are indicated. Of course, in order to take maximum advantage of the invention, the highest permissible temperatures should be used. If the process is operated at the low end of the temperature range, all other factors being equal, longer press cycles will be required in order to provide the desired degree of out-of-press board strength and moisture content.

The press cycle time for a given press temperature is, in part, governed by the desired out-of-press moisture content. Moisture contents "out-of-press" may range from about 5% to about 40% (on dry weight basis). The preferred range is from about 15% to about 30% (on dry weight basis). An out-of-press moisture content as low as 5% will require longer press cycle times and is, in general, not recommended. At the other end of the scale a moisture content higher than 40% may produce a board which is too weak to be handled effectively after the press and/or is subject to delamination and other structural problems. The addition of extra binder resin may be of assistance in this instance. For best overall results the out-of-press moisture range should be between 15 to 30% with the moisture content preferably being kept towards the high end of this range in order to assist in providing the shortest press cycle times.

In order to reduce press cycle time to a minimum for any particular set of circumstances, the press should be "closed" i.e. brought to the stops, in the minimum time permitted without structurally damaging the mat. The total time at pressure is dependent on the various factors noted previously including the fibre furnish used, press temperatures, out-of-press moisture content, final board thickness and density so it is therefore difficult to generalize; however, under the most favourable conditions, the time at pressure i.e. closed on the stops, can be reduced to 2 minutes or slightly less for ¼ inch nominal thickness board of the type under consideration, which represents a vast saving in time over prior art S-1-S processes.

Generally speaking, by selecting the most favourable processing conditions, the total press cycle time for ¼ inch nominal thickness board can be reduced to about 3 minutes or somewhat less, while for ½ inch thickness board the total press cycle time can be reduced to about 8 minutes or somewhat less. These times include the times taken to "close" and to "open" the press.

Under certain circumstances the use of a "release sheet" during pressing may be desirable, especially if temperatures toward the upper ends of the ranges given are being used and decorative panelling is being produced. This is particularly true in the case of embossed decorative overlay panels. The use of a cushioning sheet of non-adhering type material (termed a "release sheet") inserted between the top surface of the board mat and the hot platen or hot caul plate, before hot pressing, helps to preserve the condition and appearance of the decorative board surface. Sheet materials such as glassine, parchment, greaseproof, and specially treated kraft papers may be used. It is important that such release sheets have a very fine fibre composition as well as good releasing characteristics if the finished board surface is to be kept free of embossed fibrous texturing, which will result from the use of more coarsely fibred release sheets. Usually such texturing is acceptable on embossed products but not on smooth surfaced panels.

One of the principal reasons for using release sheets in the present short cycle process for the embossed decorative overlay is to prevent the possibility of overlay cracking. Release sheets may also be required under certain conditions, e.g. at the high temperatures mentioned previously, e.g. 235° C to 245° C, (approximately 450° to 470° F) even with flat (unembossed) decorative panels to avoid any possibility of discolouration. A release sheet is not usually needed on plain (i.e. non-decorative) overlay, flat or embossed, even at the highest temperature ranges.

After hot pressing, the semi-cured boards are removed from the press, separated from their bottom carrying screens and loaded into buggies in such a manner (preferably in the horizontal position) as to avoid distortion and damage, and then heat treated in the usual fashion e.g. for several hours at temperatures around 150° C ambient air temperature to complete the curing process, and then passed through a humidification chamber to bring the boards up to the desired moisture content, usually around 7% by weight.

The final boards produced in accordance with the invention will, depending on the precise process conditions, exhibit medium range densities approximately in the specific gravity range 0.60 to 0.85, with the preferred specific gravity range being from about 0.70 to about 0.82.

After baking and humidifying, the boards are cut to the required size and given such additional finishing treatments as desired. For example, interior decorative panels may be provided with decorative plank stripes and a clear protective surface finish. Boards with the non-decorative overlay or with no overlay are painted in accordance with customer requirements or sold as raw board.

The following examples will further serve to illustrate the process:

EXAMPLE 1

In a mill trial run, a wood chip mixture of pine, oak and other mixed hardwoods, including bark, was steam cooked in Bauer Rapid Cycle steaming digesters at 130 p.s.i.g. steam pressure for 2½ minutes, following a 20-second pre-heat steam purge. After steam cooking, the hot, softened chips were fed from the blow bin at atmospheric pressure to Bauer No. 411 double rotating disc pressed fiberboard stock mechanical refiners fitted with Bauer No. 40504, −05, Ni-hard X-alloy matching plates, and refined at 8% consistency to produce a good quality, free draining (6 seconds, Williams) fibre having a Shrinkability Value of +27 mils as determined in the afore-described Shrinkability Value test procedure.

To an aqueous dispersion (approximately 3% consistency) of this fibre in a mix chest were added 1½% phenolic resin, ½% paraffin wax emulsion, and 1% alum. The phenolic resin was a water soluble, acid precipitable, alkaline phenol formaldehyde advanced Redfern type commonly used in wet process pressed fiberboard manufacture and capable of producing in-press bonding under the still moist conditions prevailing at the end of the short cycle. All additive amounts are in terms of solids on total final board solids by weight. Resultant pH of the fibre-chemical mix was about 4.0.

The resulting furnish mix was then formed into a conventional wet process fiberboard lap on a Fourdrinier forming machine at a basis weight of 900 lb. (dry) per thousand square feet (M.s.f.) and dewatered by suction boxes and cold presses to a consistency of approximately 30% (i.e. 70% moisture content).

To the surface of this cold pressed wet lap was applied a 32 lb./ream (3000 sq.ft.) decoratively printed woodgrain newsprint type paper overlay having on its underside (i.e. side next to the wet lap substrate top surface) a freshly applied bonding treatment of 3½ lb./M.s.f. of a mixture comprising raw linseed oil catalyzed with 5% by weight boron trifluoride. The endless wet lap (still at 30% consistency) with its overlay was then cut into 16 ft. lengths and conveyed on carrying screens into the hot press.

The hot press was fitted along its long sides with solid steel stop bars 1-inch wide and 0.300-inch thick, resting on the lower platen surface. Temperature of the hot platens was 230° celsius (approximately 450° F). The top caul plate of the press was not embossed. The press was closed in 15 seconds and the wet mat pressed to stops at 240 p.s.i. (on board). After 2 minutes at this pressure, the press was opened, the opening taking 45 seconds. The total press cycle time, including closing and opening, was three minutes, and actual time at pressure was 2 minutes.

The hot pressed boards, now at 25% moisture content and a caliper of 0.280-inch (less than stop thickness), were removed from the press without any delamination or "blow-out" problems, separated from their bottom carrying screens, loaded horizontally into buggies, heat treated in a conventional continuous in-line pressed fiberboard baking over for seven hours at 150° celsius (approximately 300° F) ambient air temperature and passed through humidification chambers to attain 7% moisture content.

On inspection, final board masters were uniformly flat and woodgrain surface patterns were excellent, with no discolouration or loss of pattern brightness and detail. Substrate core was rigid and structurally sound, having neither blisters nor delaminations.

Final boards, on testing, exhibited good consolidation and strength, having the following typically excellent physical properties for interior pressed fibreboard wall panelling:

| | |
|---|---|
| Caliper | 0.250-inch |
| Specific Gravity | 0.77 |
| Water Absorption (24-hour immersion under 1 inch water at 21° C-approximately 70° F) | 17% |
| Swell (24-hour immersion under 1 inch water at 21° C-approximately 70° F) | 6% |
| Modulus of Rupture | 4000 p.s.i. |
| Tensile Strength (parallel to surface) | 2000 p.s.i. |
| Tensile Strength (perpendicular to surface) | 60 p.s.i. |
| Nailability | Excellent |

EXAMPLE 2

Board was made following the general procedure outlined in Example 1. However, the top caul plate of the press was provided with a textured surface representative of a woodgrain pattern complementary to and compatible with the woodgrain pattern on the printed overlay paper as described in U.S. Pat. No. 3,576,711 (Baldwin). In order to eliminate the possibility of cracking of the paper overlay, a glassine type release sheet 1.9 mils in thickness was positioned over the woodgrain paper overlay prior to pressing. After pressing, the embossed decorative woodgrain overlay was observed and it was noted that there was no evidence of paper overlay cracking. Again, there was no evidence of surface discolouration or loss of pattern brightness and detail.

EXAMPLE 3

Pressed fibreboard with printed woodgrain overlay was produced according to the general procedure described in Example 1 except that the mat weight was 1500 lb. (dry)/M.s.f. and the press was fitted with 0.500 inch thick stop bars. The total press cycle time was 7½ minutes (as compared to 20–25 minutes for boards of this weight in conventional processes). Out-of-press moisture content (on dry basis) was 25%

The final boards had a thickness of 0.42 inches and a specific gravity of 0.75. Surface appearance was excellent with full pattern brightness and detail, and physical properties of the substrate were again typically suitable for interior wall panelling use.

EXAMPLE 4

The ineffectiveness of fibre having a Shrinkability Value of greater than +120 mils is demonstrated by the following example.

Pressed fibreboards were made in the laboratory according to the mill procedure and starting with the same wood chip furnish described in Example 1 except that steaming and refining were both carried out on a Bauer 418 pressurized refiner at 90 p.s.i.g. stream pressure. Steaming dwell time was 3 minutes prior to actual defibration. Consistency at defibration stage was 19%. Drainage of the resultant fibre was similar at 5 seconds (Williams) but the Shrinkability Value was +243 mils instead of +27 mils.

On opening the hot press, the pressed board had not shrunk but rather had increased (expanded) in thickness. The resultant board, even after post heat treatment, was poorly consolidated, low in density (specific gravity = 0.54), very weak internally (perpendicular tensile strength = 4 p.s.i.) and was judged to be unacceptable as interior wall panelling.

We claim:

1. The process of producing pressed fiberboard including the steps of providing an aqueous slurry of wood fibre, dewatering said slurry to form a wet mat, hot pressing said mat between a pair of heated upper and lower press members to remove a substantial portion of the water in said mat and to cause binding of the fibres to form a board, and subsequently moving the press members apart and removing the board therefrom, said press having control means therein to limit the degree of advance of the press members toward one another, and wherein said fiber has a Shrinkability Value not higher than about +120 mils such that during said hot pressing the mat of fibres shrinks in thickness while at the same time said press members are prevented from moving toward one another by said control means, with said shrinkage being sufficient to permit gradual dissipation of steam pressures generated within the board being formed thus permitting the press members to be moved apart and the board removed while said board still contains a substantial quantity of moisture therein without incurring delamination of the board by virtue of unrelieved steam pressures therein.

2. The process according to claim 1 wherein said fibre has a Shrinkability Value not higher than about +100 mils.

3. The process according to claim 1 wherein said fibre has a Shrinkability Value not higher than about +80 mils.

4. The process according to claim 1 wherein said mat is supported on a screen or screen-like surface during said hot pressing and wherein a paper overlay is applied to the upper surface of the wet mat prior to hot pressing with said shrinkage of the wet mat during pressing assisting in preventing overheating and discolouration of the overlay by the upper press member during said hot pressing.

5. The process according to claim 4 wherein said press members are at a temperature of from about 190° C to about 260° C.

6. The process according to claim 5 wherein said paper overlay is decorated and wherein said temperature is not greater than about 245° C.

7. The process according to claim 4 wherein said fibre has a Shrinkability Value not higher than about +100 mils.

8. The process according to claim 4 wherein said fibre has a Shrinkability Value not higher than about +80 mils.

9. The process according to claim 1 wherein said board has a moisture content at the end of said hot pressing from about 5% to about 40% on a dry weight basis.

10. The process according to claim 1 wherein said board has a moisture content at the end of said hot pressing from about 15% to about 40% on a dry weight basis.

11. The process according to claim 1 wherein said board has a moisture content at the end of said hot pressing from about 15% to about 30% on a dry weight basis.

12. The process according to claim 9 further including the steps of baking the pressed boards to complete the cure of same and then subsequently humidifying same with said boards then having a specific gravity from about 0.60 to 0.85.

13. The process according to claim 12 wherein a thermosetting resin is added to said slurry to increase the strength of the board exiting from the hot press.

14. The process of producing pressed fiberboard including the steps of providing an aqueous slurry of wood fibre, dewatering said slurry to form a wet mat, hot pressing said mat between a pair of heated upper and lower press members to remove a substantial portion of the water in said mat and to cause binding of the fibres to form a board, and subsequently moving the press members apart and removing the board therefrom, limiting, by way of control means in said press, the degree of advance of the press members toward one another during the hot pressing of the mat, and wherein said fibre has a Shrinkability Value not higher than about +120 mils so that during said hot pressing the mat of fibres shrinks sufficiently in thickness to reduce the pressure between itself and the upper press member which has been limited in its degree of advance toward the lower press member by the control means.

15. The process according to claim 14 wherein said fibre has a Shrinkability Value not higher than about +100 mils.

16. The process according to claim 14 wherein said fibre has a Shrinkability Value not higher than about +80 mils.

17. The process according to claim 14 wherein said mat is supported on a screen or screen-like surface during said hot pressing and wherein a paper overlay is applied to the upper surface of the wet mat prior to hot pressing with said shrinkage of the wet mat assisting in preventing overheating and discolouration of the overlay by the upper press member during said hot pressing.

18. The process according to claim 17 wherein said press members are at a temperature of from about 190° C to about 260° C.

19. The process according to claim 18 wherein said paper overlay is decorated and wherein said temperature is not greater than about 245° C.

20. The process according to claim 17 wherein said fibre has a Shrinkability Value not higher than about +100 mils.

21. The process according to claim 17 wherein said fibre has a Shrinkability Value not higher than about +80 mils.

22. The process according to claim 17 wherein said board has a moisture content at the end of said hot pressing from about 5% to about 40% on dry weight basis.

23. The process according to claim 17 wherein said board has a moisture content at the end of said hot pressing from about 15% to about 40% on dry weight basis.

24. The process according to claim 17 wherein said board has a moisture content at the end of said hot pressing from about 15% to about 30% on dry weight basis.

25. The process according to claim 23 further including the steps of baking the pressed board to complete the curing of same and then subsequently humidifying same with said board then having a specific gravity from about 0.60 to 0.85.

26. The process according to claim 25 wherein a thermosetting resin is added to said slurry to increase the strength of the board exiting from the hot press.

27. A process for making pressed fiberboard panelling comprising providing an aqueous slurry of wood fibers, dewatering said slurry to form a wet mat, applying an overlay paper to the upper surface of the mat and positioning said mat in a press between a pair of heated upper and lower press platens having control means associated therewith dimensioned in preselected relation to the ultimate thickness and density desired for the pressed fiberboard panelling, which control means determine the minimum distance between the press platens during pressing, said press platens being maintained at a temperature from about 190° C to about 260° C, pressing the mat which pressing includes forcing the platens to move toward one another until said minimum distance determined by said control means exists between them, the mat being supported on means permitting expressed water to escape therefrom during the pressing of the mat to consolidate the fibres and to form a board, and wherein said fibre has a Shrinkability Value not higher than about +120 mils so that during pressing of the mat between said platens, as they are maintained said minimum distance apart by said control means, the mat shrinks sufficiently to reduce the pressure between itself and the upper press platen, thus allowing dissipation of steam pressures generated within the board being formed and reducing the amount of time that the paper overlay remains in intimate pressurized contact with the heated upper press platen, and subsequently moving said press platens apart and removing said board from the press while said board still contains from about 5% to about 40% by weight moisture therein on a dry weight basis.

28. The process according to claim 27 wherein said press platens are maintained at a temperature from about 205° to about 235° C.

29. The process according to claim 27 wherein said Shrinkability Value is not greater than about +100 mils.

30. The process according to claim 27 wherein said Shrinkability Value is not greater than about +80 mils.

31. The process according to claim 27 wherein said board contains from about 15% to about 40% by weight water therein on a dry weight basis at the time of removal from the press.

32. The process according to claim 27 wherein said board contains from about 15% to about 30% water therein on dry weight basis at the time of removal from the press.

33. The process according to claim 32 wherein said fibre contains thermosetting binder resin therein to assist in providing strength to the board as removed from the press.

34. The process according to claim 33 further including the step of baking the pressed board to complete the curing of same and then subsequently humidifying said board.

35. The process according to claim 34 wherein the final board has a thickness of about $\frac{1}{4}$ inch and wherein the time taken by said hot pressing is in the order of about 3 minutes.

36. The process according to claim 34 wherein the final board has a thickness of about $\frac{1}{2}$ inch and wherein the time taken by said hot pressing is in the order of about 8 minutes.

* * * * *

UNITED STATES PATENT AND TRADEMARK OFFICE

CERTIFICATE OF CORRECTION

PATENT NO. : 4,038,131
DATED : July 26, 1977
INVENTOR(S) : Baldwin et al

It is certified that error appears in the above-identified patent and that said Letters Patent are hereby corrected as shown below:

Column 4, line 50, should read "6 inch x 6 inch"

Column 4, bottom, Shrinkability Value formula should read "Shrinkability Value = Dried Mat Thickness (mils) - Cold Pressed Mat Thickness (mils)"

Column 6, line 23, "wet" should be "web"

Figure 2:
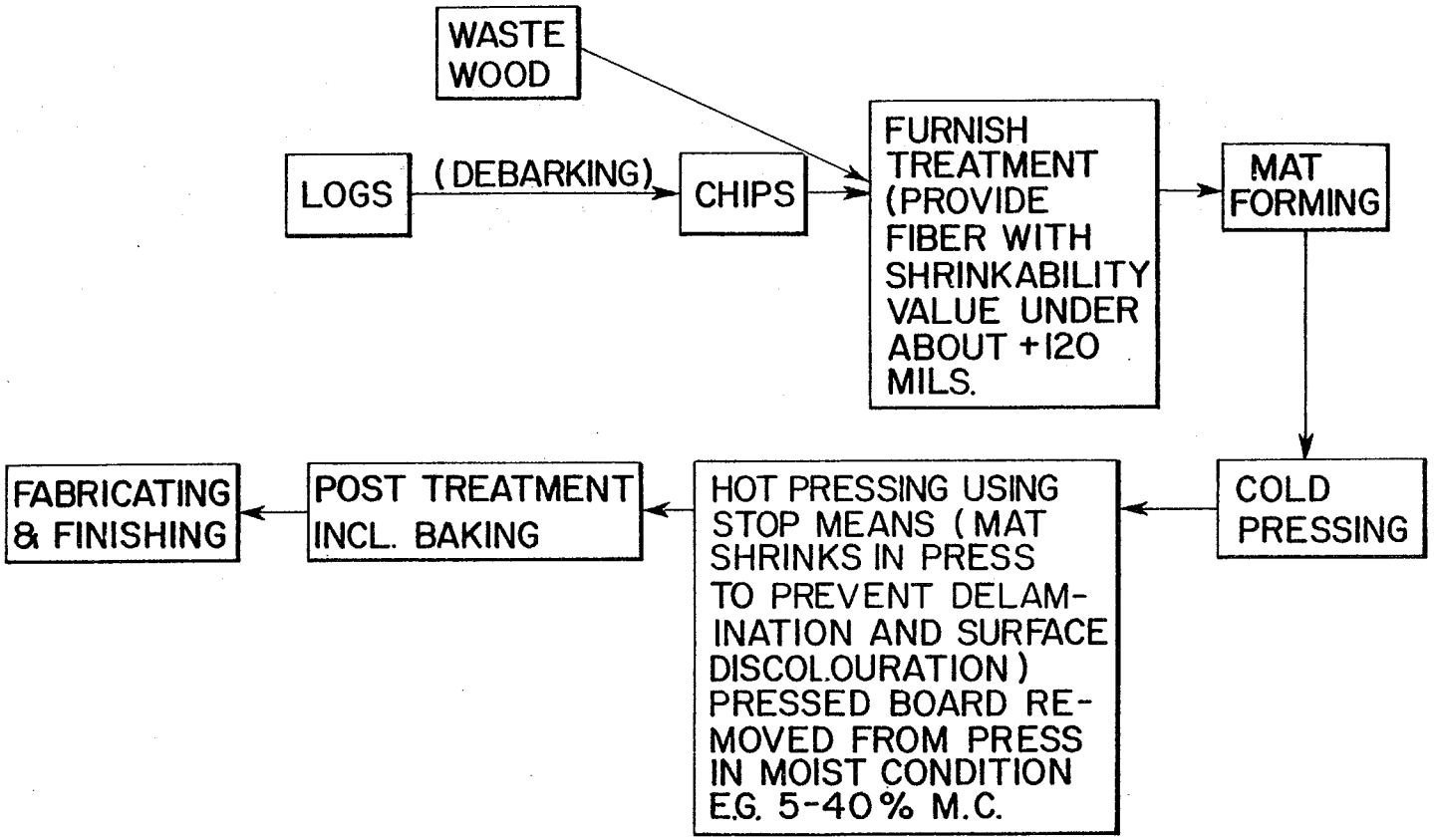
FIG. 2 is a flow sheet illustrating the principal steps of the process of the present invention.

In Fig. 2, there should be a close parenthesis after the word "mils" in the Furnish Treatment box Signed and Sealed this Sixth Day of December 1977

[SEAL]

*Attest:*

RUTH C. MASON
*Attesting Officer*

LUTRELLE F. PARKER
*Acting Commissioner of Patents and Trademarks*